US005706589A

United States Patent [19]

Marc

[11] Patent Number: 5,706,589

[45] Date of Patent: Jan. 13, 1998

[54] ENERGY MANAGING SHOE SOLE CONSTRUCTION

[76] Inventor: Michel Marc, 1 Silver Hill—Unit #1, Natick, Mass. 01760

[21] Appl. No.: 662,706

[22] Filed: Jun. 13, 1996

[51] Int. Cl.[6] ..... A43B 13/28; A43B 13/20

[52] U.S. Cl. ..... 36/27; 36/29

[58] Field of Search ..... 36/27, 29, 28, 36/7.8

[56] References Cited

U.S. PATENT DOCUMENTS

| | | | |
|---|---|---|---|
| 4,414,760 | 11/1983 | Faiella | 36/29 |
| 4,446,634 | 5/1984 | Johnson et al. | 36/29 |
| 5,416,986 | 5/1995 | Cole et al. | 36/29 |
| 5,437,110 | 8/1995 | Goldston et al. | 36/27 X |

FOREIGN PATENT DOCUMENTS

| | | |
|---|---|---|
| 2658396 | 8/1991 | France . |
| 9116831 | 11/1991 | WIPO . |
| 93012685 | 7/1993 | WIPO . |

*Primary Examiner*—Ted Kavanaugh
*Attorney, Agent, or Firm*—Barry R. Blaker

[57] ABSTRACT

Disclosed herein is an energy managing shoe sole construction wherein, during the stance phase of the wearer's gait cycle, the impact energy of the heel strike is absorbed, stored and, at least in part, returned to the underside of the forefoot during the propulsive phase of the gait, thereby aiding in the locomotion of the wearer. Following the propulsive phase of the gait cycle the sole construction is restored to a condition suitable for absorption and storage of the impact energy of the next heel strike event thereupon. Included within the sole construction is a control system which is responsive to the changing anatomy of the foot during the gait cycle and which control system manages the timing of the transfer of the absorbed and stored heel strike energy to the forefoot.

8 Claims, 6 Drawing Sheets

ENERGY MANAGING SHOE SOLE CONSTRUCTION

BACKGROUND OF THE INVENTION

The present invention relates generally to footwear and is more particularly related to a shoe sole construction wherein the impact energy of the heel strike is absorbed, stored and at least a portion of this stored energy is beneficially returned to aid in the propulsion of the wearer during the propulsive phase of the human gait.

In human locomotion the walking gait cycle is generally considered as comprising two distinct phases: (a) the stance phase, and (b) the swing phase. The beginning of the stance phase is signalled by the heel strike of the foot against the support surface. At this point of the cycle the foot begins to become loaded with body weight and, in response, pronates, thereby to result in a lowering of the medial longitudinal arch, an outward turning of the foot and an inward rotation of the leg. During this pronation of the foot the bony articulations or joints of the mid and hind foot loosen somewhat in order that the foot can both adjust to the support surface and absorb the mechanical shock of heel strike and weight bearing. As the plantar surface of the foot rolls forward onto the support surface, and at some point subsequent to midstance, the heel begins to invert and the foot beings to resupinate. At this juncture of the stance phase the forefoot is fixed to the support surface, the heads of the first and fifth metatarsals are splayed apart and the foot is in a rigid structural condition and, ideally, in a neutral, that is to say, neither pronated nor supinated, position. Next, plantar-flexion of the foot begins, the arch becomes rigid and the heel lifts off the support surface, usually with accompanying further supination. The plantar fascia shortens and the toes begin to flex, creating a so-called "windlass effect" whereby the arch is elevated and which constitutes the final or "propulsive" segment of the stance phase immediately preceding the beginning of the swing phase of the gait cycle and the heel strike of the opposite foot. In the normal swing phase, during which the foot is lifted entirely off the support surface and, therefore, is in a non-weight bearing condition, the ideal foot returns from its supinated position to a neutral position, as do the articulations of the fore, mid and hind foot, all in preparation for the onset of the foot's next stance or weight bearing phase.

Unlike walking, wherein at least a portion of the gait cycle involves double-limb support of the body and a sharing of the body weight therebetween, the running gait cycle includes a third or "float" phase interposed between the stance and swing phases and during which "float" phase both feet are off the ground and following which only one foot receives the entirety of the ground impact forces. Too, the stance or weight bearing phase is substantially shorter than in walking. Thus, in running, the ground contact impact forces imposed upon the anatomy of the foot are substantially greater, usually about three times greater, and require the foot, leg, hip and spinal anatomy to accomodate these stresses over a substantially shorter period of time than in walking. These factors particularly associated with the running gait thus pose an ever present orthopedic threat to the well being of the runner's anatomy of locomotion and have spawned the development of various energy absorptive devices for use in footwear. In general, the known protective devices for runners and athletes take the form of various compressible viscoelastic pads and pillows installed as insole elements under the heel or entire foot of the wearer and which serve to absorb at least a substantial portion of the impact energy of the heel strike. Usually, these devices act by compression under the loads imposed by the heel strike and by conversion of this mechanical energy into heat. While effective to various degrees in providing physical protection to the anatomy of locomotion, particularly to that of the foot, the heat generated within these devices can contribute to an uncomfortably warm environment within the wearer's shoe. Moreover, the impact energy absorbed by these devices is simply dissipated and is not returned in any beneficial way to the wearer. In accordance with the present invention, however, these deficiencies have been successfully addressed.

OBJECTS OF THE INVENTION

It is a principal object of the invention to provide a novel shoe sole construction adapted to absorb at least a portion of the impact energy of the heel strike of the wearer.

It is another object of the invention to provide a shoe sole construction wherein the impact energy of the heel strike of the wearer is absorbed and attenuated with little or no net generation of heat within the shoe.

It is another object of the invention to provide a novel shoe sole construction wherein at least a portion of the impact energy of the heel strike is absorbed, stored and then reconverted into mechanical energy under the forefoot to aid in the propulsion of the wearer.

Other objects and advantages of the present invention will, in part, be obvious and will, in part, appear hereinafter.

SUMMARY OF THE INVENTION

In accordance with the invention there is provided a shoe sole construction comprising a shoe sole element composed of a resilient elastomeric material and having heel and forefoot portions. Disposed under the forefoot portion of the shoe sole is a rigid thrust plate which is pivotally affixed to the toe of the sole. Disposed within the heel portion of the sole are impact absorption means to absorb at least a portion of the mechanical energy of the heel strike. Additional means, associated with said energy absorption means, are provided by which to store at least a portion of the mechanical energy of the heel strike. Disposed within the forefoot portion of the sole are propulsion means to receive the stored mechanical energy of the energy storage means and to propel the pivotally affixed thrust plate downwardly in response thereto. Included within the construction of the invention are control means, responsive to the changing anatomy of the wearer's foot during the act of running, and which control means conveys the stored mechanical energy of the heel strike to the propulsion means during the propulsive phase of the running gait.

DESCRIPTION OF PREFFERED EMBODIMENTS

Figure 1:
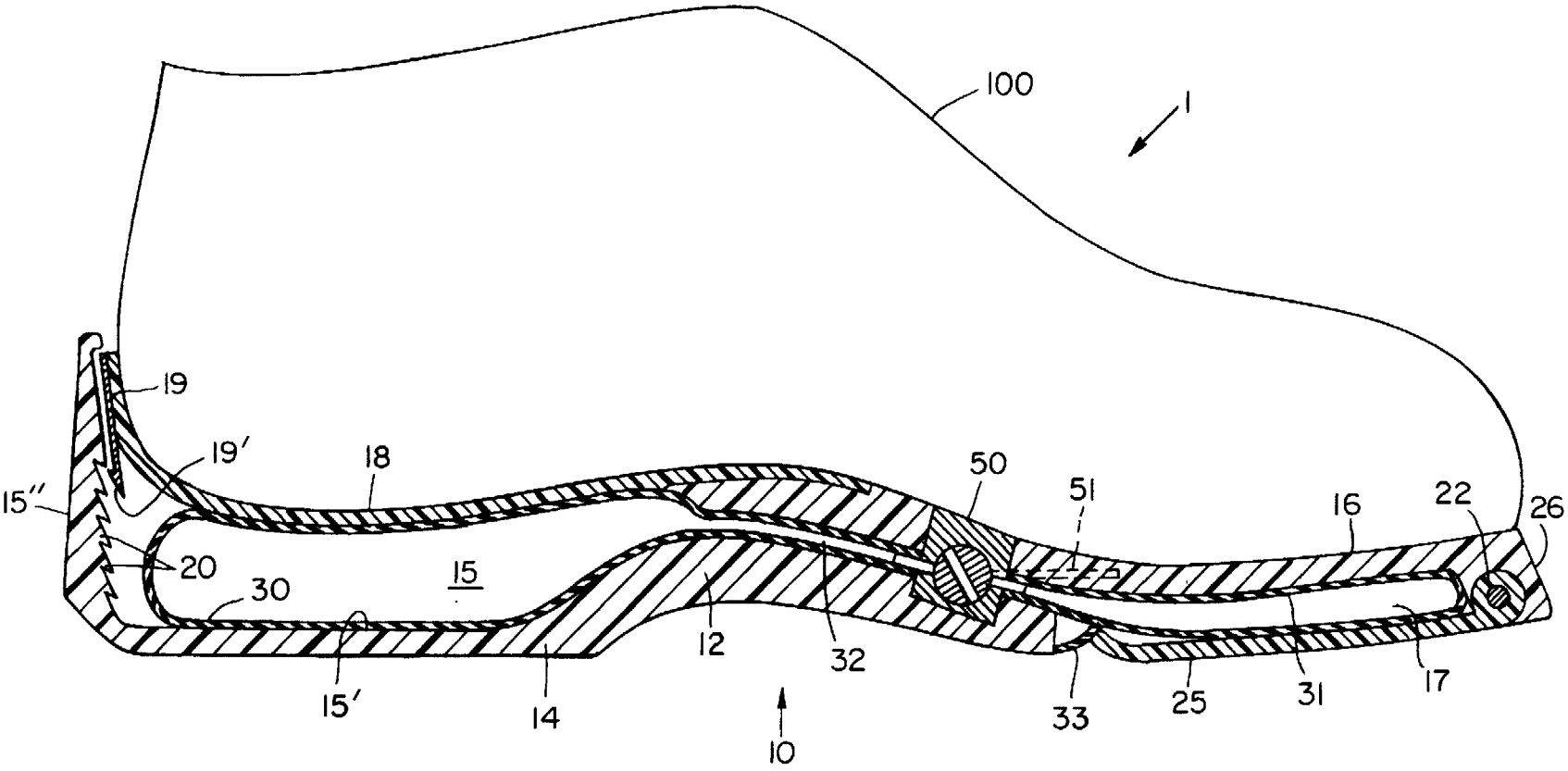
FIG. 1 hereof is a schematic, diagrammatic, sectional side view of a preferred embodiment of the shoe sole construction of the invention and showing a shoe during the swing or float phase of a runner's gait during which the anatomy of the foot is restored to a prepared condition for absorbing the impact energy of the next heel strike of the runner.

Referring now to FIGS. 1 through 5 hereof, wherein like reference numerals refer to like structures, there is shown a shoe 1 generally comprising a shoe sole construction 10 and a shoe upper 100. The shoe sole construction 10 comprises an elastomeric or rubber shoe sole element 12 running throughout the length of the shoe and having heel and forefoot portions 14 and 16 corresponding to the heel and forefoot, respectively, of the wearer. It should be noted that for purposes of the present invention the term "forefoot" is intended to denote that portion of the foot which is maximally responsible for propulsive contact of the foot with the support surface and may be broadly anatomically defined as that portion of the foot existing between the distal ends of the metatarsals and the distal ends of the phalanges. Heel portion 14 comprises a heel recess 15 defined in the upper surface of the shoe sole element 12 while forefoot portion 16 comprises a recess 17 defined in the underside thereof.

Disposed above the heel recess 15 is a relatively rigid heel pressure plate 18 which is shaped to receive the heel of the foot of the wearer and which is affixed to the shoe sole element 12 so to allow up and down movement thereof relative to the floor 15' of heel recess 15. The provision of this relative movement capability may be had, for instance, by affixing only the forward end of the pressure plate 18 to the upper surface of the shoe sole element 12 at a location forward of the heel recess 15, such as at a location corresponding to the arch of the foot. Affixed to and depending from the rear end of the pressure plate 18 is a latch element 19 having a latching barb 19' at the depending free end thereof. Said barb 19' is in latchingly cooperative association with a plurality of sawtooth notches 20 molded into the interior surface of the rear wall 15" of heel recess 15. As will be appreciated particularly by reference to FIGS. 2 through 4, the heel pressure plate 18 is forced downwardly relative to floor 15' of the heel recess 15 by the impact of the heel strike thereby bringing the latching barb 19' into correspondence with one or another of the sawtooth notches 20. As will be further explained hereinafter, a bladder 30 located within heel recess 15 is compressed as a result of the heel strike and bears against the front of the latch element 19, thereby biasing the barb 19' thereof rearwardly and into battery with its corresponding notch 20 and latching the heel pressure plate 18 at this downwardly displaced condition throughout the period of compression of the bladder 30. As best seen in FIG. 5, upon release of pressure from the bladder 30 its rearward biasing of the latch element 19 ceases, thereby allowing the barb 19' to move forwardly out of latching engagement with the notch 20 and freeing the heel pressure plate 18 to move upwardly relative to the floor 15' of the heel recess 15.

Disposed under the recess 17 of forefoot portion 16 is a rigid thrust plate 25 which is pivotally affixed to the toe 26 of the sole element 12 by means of a tranverse hinge 22.

Figure 2:
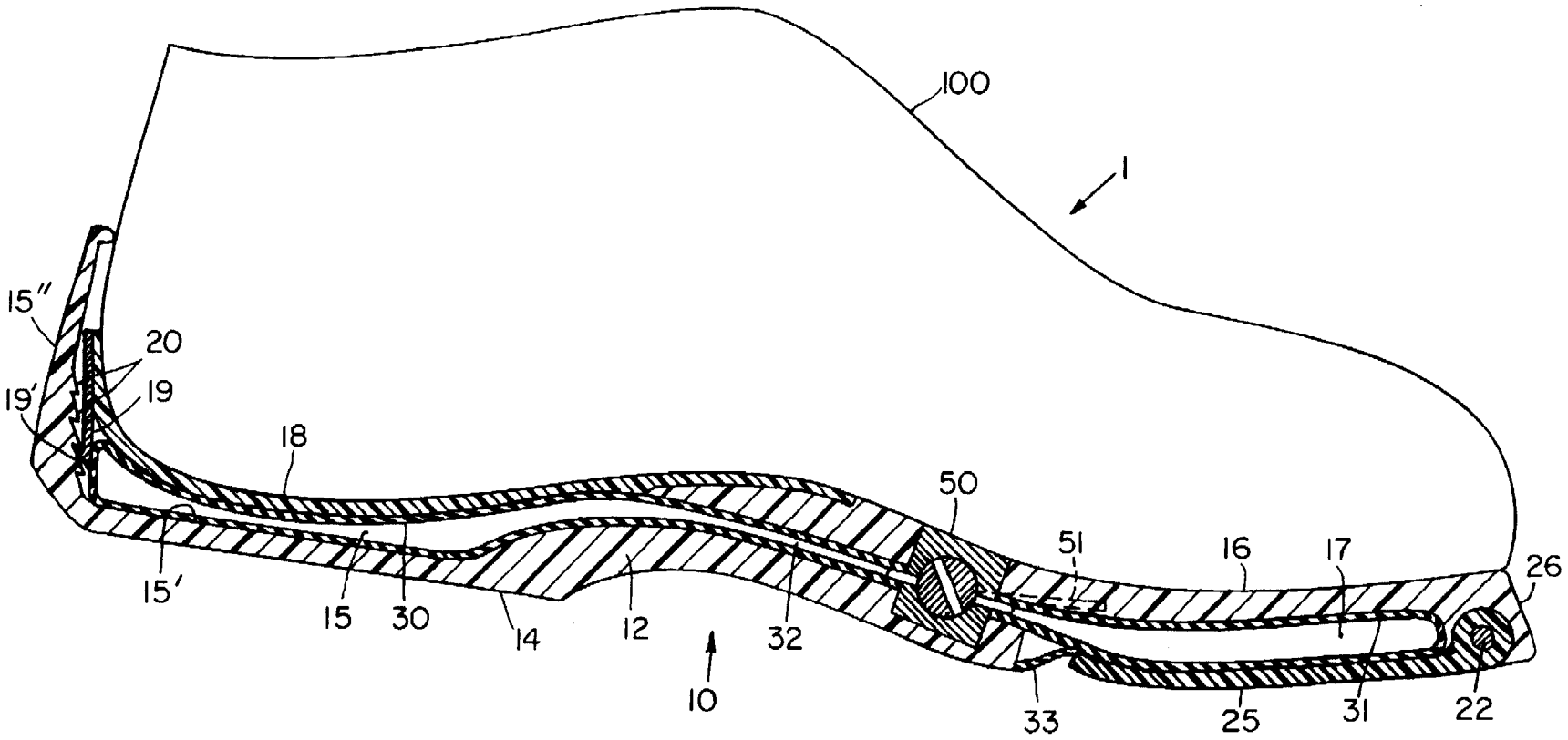
FIG. 2 hereof is a schematic, diagrammatic, sectional side view of the shoe of FIG. 1, taken at a point in the stance phase of the running gait of a wearer following the heel strike of the foot and as the foot begins to roll forwardly to enter the propulsive phase of the gait.
Figure 3:
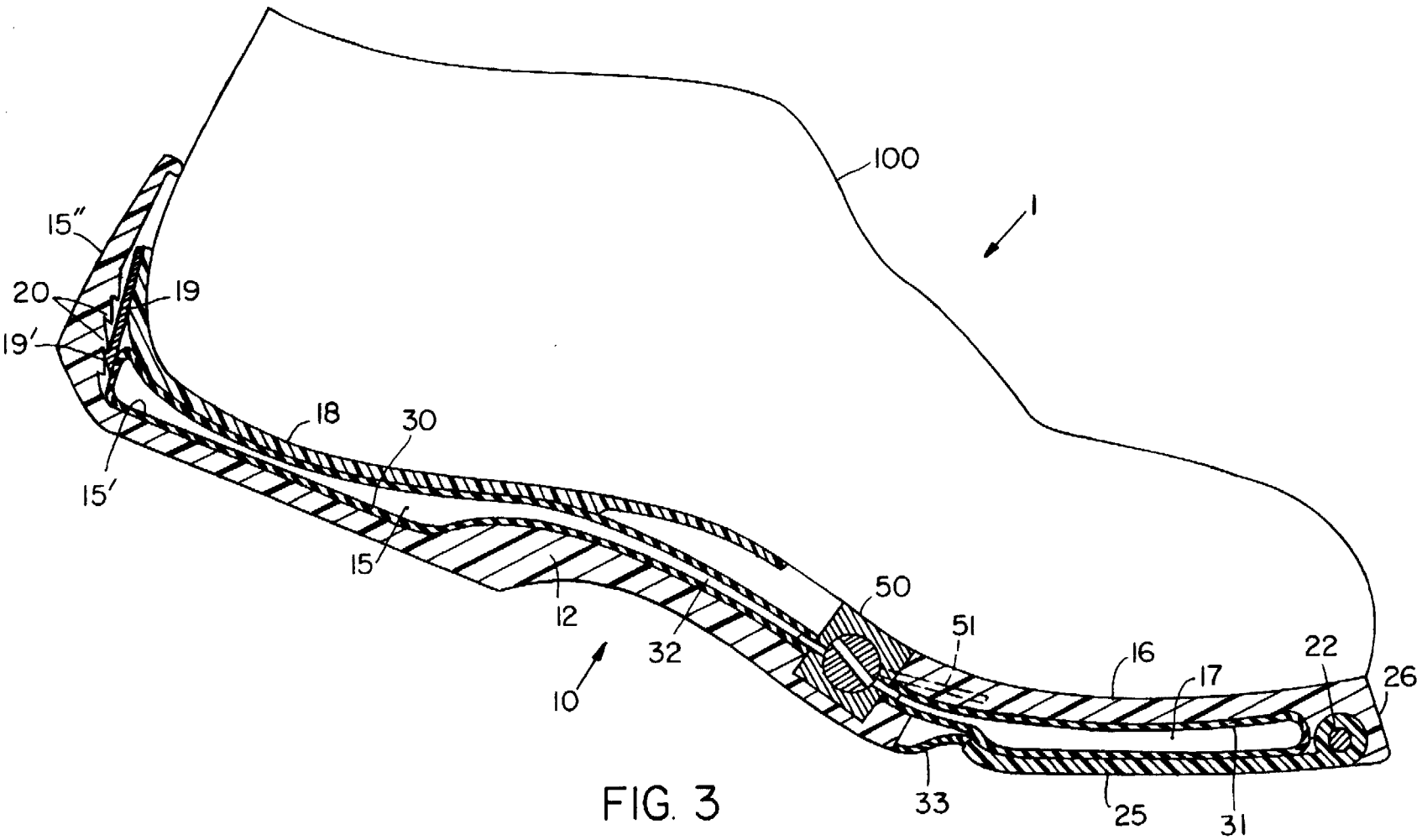
FIG. 3 hereof is a schematic, diagrammatic, sectional side view of the shoe of FIGS. 1 and 2, taken at a point in the stance phase of the running gait of a wearer as the foot continues to roll forwardly, thereby transferring the full weight of the wearer onto the forefoot and signalling the onset of the propulsive phase of the gait.
Figure 4:
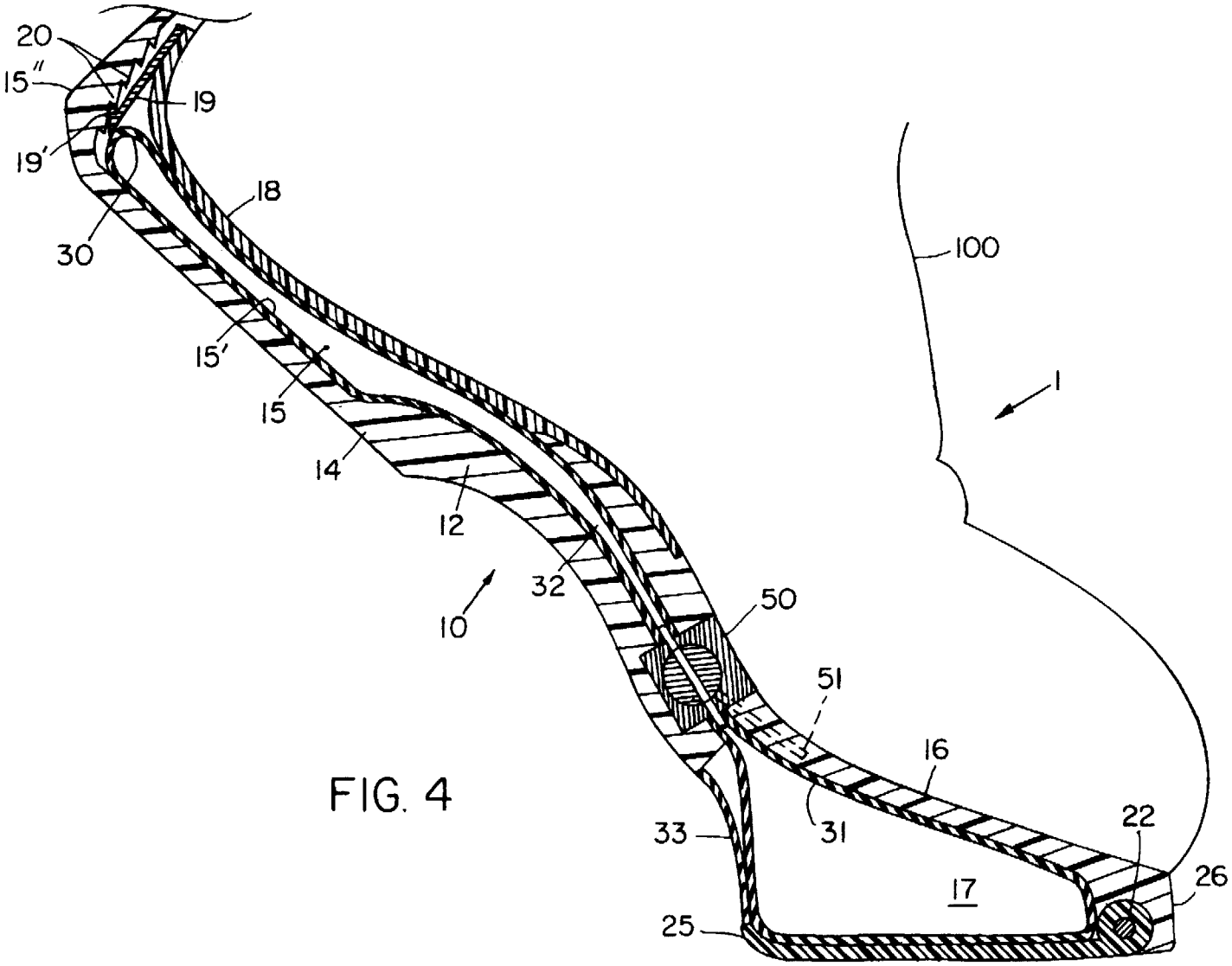
FIG. 4 here is a schematic, diagrammatice, sectional side view of the shoe of FIGS. 1 through 3, taken during the propulsive phase of the running gait of a wearer.
Figure 5:
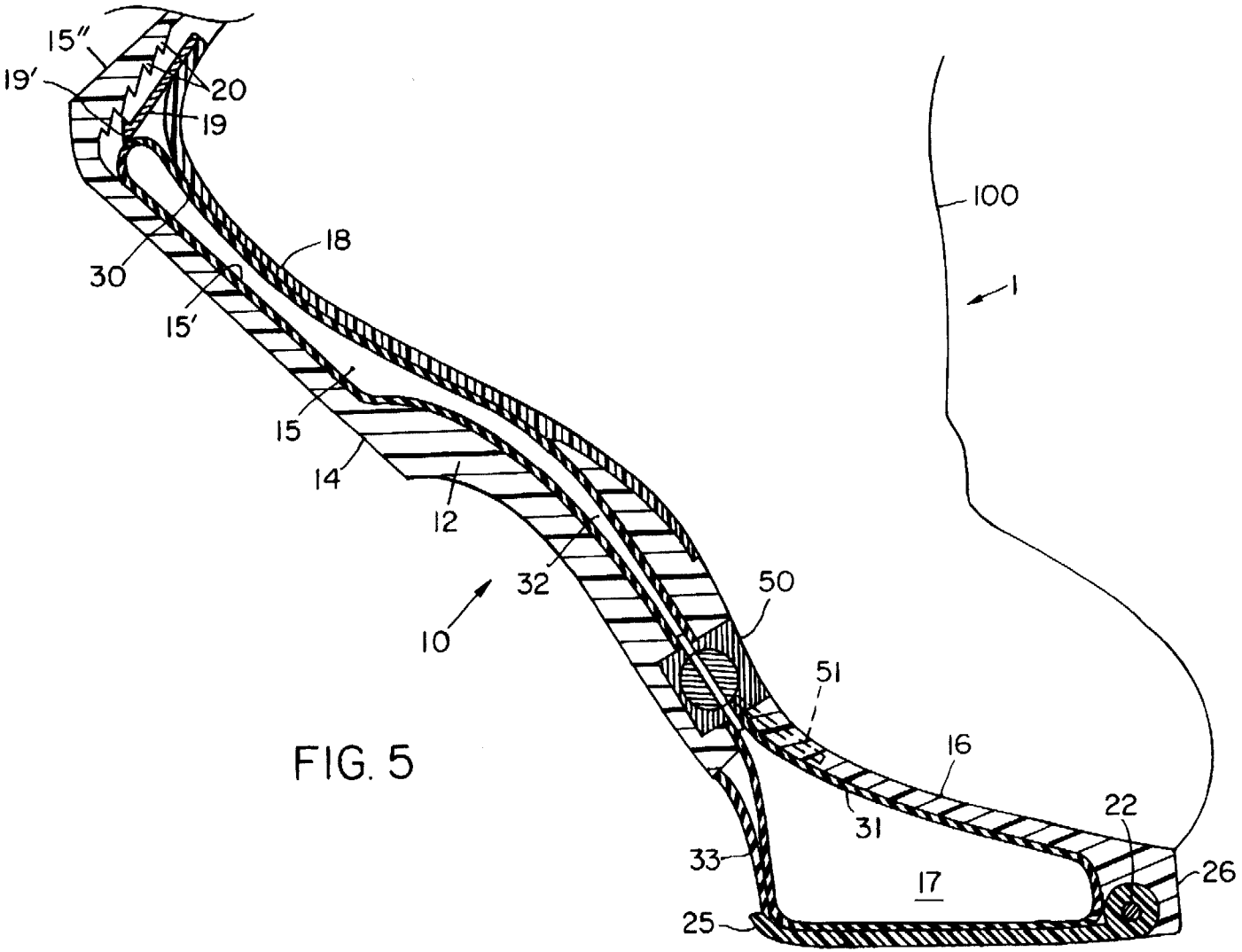
FIG. 5 hereof is a schematic, diagrammatic, sectional side view of the shoe of FIGS. 1 through 4, taken at the completion of the propulsive phase of the running gait and wherein the sole construction of the invention initiates restoration of its heel strike condition.

Turning now to the energy absorption, control and recovery elements of the embodiment of the invention shown in FIGS. 1 through 5, there is located within the heel recess 15 a resiliently expansible pneumatic bladder 30 and within the recess 17 of the forefoot portion 16 a resiliently expansible pneumatic bladder 31. As best shown in FIGS. 4 and 5 the space defined between the forefoot recess 17 and thrust plate 25 is closed by means of a resilient collar 33 formed of an elastomeric membrane and which collar surrounds and is continuously affixed to the perimeters of each of these elements. Said collar provides physical protection of the bladder 31 from contact with external ground debris and also provides a restorative biasing of the thrust plate 25 towards the closed condition when in the open position shown in said FIGS. 4 and 5. Said bladders 30 and 31 are in controlled fluid communication with one another through a passageway 32 which runs from the front of heel recess 15 through the material of sole element 12 underlying the arch of the foot and into the rear of recess 17. Included in the passageway 32 is a fluid control valve 50 which is responsive to open and close with respect to the changing anatomy of the running foot. In the embodiment of the invention depicted in FIGS. 1 through 5 said control valve 50 is contained in the composition of sole element 12 immediately behind the forefoot portion 16 thereof and comprises an actuator arm 51 extending forwardly into said forefoot portion 16. Thus, from the standpoint of foot anatomy, said actuator arm 51 essentially bridges the articulations between the distal heads of the metatarsals and the most proximal of the phalanges of the foot. Accordingly the actuator arm 51 is continuously responsive to the position of the forefoot anatomy and acts to open the valve 50 as the foot rolls forwardly to enter the propulsive phase of the runner's gait and to close said valve after weight bearing is removed from the foot at the termination of the propulsive phase and the forefoot has recovered its resting position during the swing or float phase of the gait (as is shown in FIG. 1). Alternative control means for valve 50 are also envisaged. For instance, while not shown, and while not constituting a preferred embodiment due to its relatively greater complexity, fragility and expense relative to the simple mechanical actuator arm 51 of FIGS. 1 through 5, suitable control of the valve 50 can also be had electromechanically, such as by means of pressure tranducers mounted in the heel portion 15 and forefoot portion of the sole element 12, said tranducers being operatively connected to suitable circuitry for: (a) receiving pressure signals from said transducers; (b) computing the appropriate times for opening and closing of the valve 50 in response to said pressure signals; and (c) transmitting open and close signals to an electrically powered control valve.

Turning to the operations of the embodiment of the invention depicted in FIGS. 1 through 5, reference is first made to FIG. 1 wherein the shoe sole construction is shown in the swing or float phase of the gait and wherein it is in a suitable condition for receiving and absorbing the impact energy of the next heel strike. In this condition, the valve 50 is closed, the latch element 19 is out of battery with any of the notches 20, and the bladder 30 is in an inflated condition, thereby to support the heel pressure plate 18 at its highest position relative to the floor 15' of the heel recess 15. With respect to the forefoot element of the construction, the bladder 31 is in a deflated condition and the pivotally affixed thrust plate 25 is in its closed position. Referring to FIG. 2, upon the heel strike of the wearer, the valve 50 remains closed, the heel pressure plate 18 is driven downwardly, thereby compressing the gas within the bladder 30 and causing it to elongate sufficiently as to bias the barb 19' of latch 19 into one or another of the notches 20 as previously explained. Thus, the impact energy of the heel strike is absorbed by the bladder 30 and is temporarily stored as compressed gas therein. Since the valve 50 remains closed at this juncture of the wearer's gait the forefoot elements of the construction of the invention remain in the condition described above in respect of FIG. 1. In FIG. 3, wherein the foot is rolling forwardly and is approaching the onset of the propulsive phase of the gait, the elements of the sole construction of the invention remain essentially as described above with respect of FIG. 2 with the exception that the valve 50 is beginning to be actuated to the open condition by the actuator arm 51, said arm being responsive to the changing anatomical condition of the wearer's foot as it enters the propulsive phase of the gait. In FIG. 4 the wearer's foot has entered the propulsive phase. Thus, in response, actuator arm 51 opens the valve 50, thereby admitting the compressed gas of bladder 30 through passageway and into the bladder 31. In consequence, the bladder 31 is inflated, driving the pivotally affixed thrust plate 25 against the ground support to its open condition, thereby augmenting the propulsive effect of the wearer's own natural gait and, in addition, tensioning the resilient collar 33. In this manner the energy previously stored in compressed bladder 30 is at least partially recovered and utilized to aid in the propulsion of the wearer. In FIG. 5 there is represented the completion of the propulsive phase of the gait and the initiation of the restoration of the shoe sole construction to its resting state in preparation for the next heel strike event. Accordingly, the valve 50 remains open and bladder 30 is deflated to the point that the spring latching element 19 is permitted to bias out of latching engagement with one or another of the notches 20. This unlatching functions to free the heel pressure plate 18 to move upwardly relative to the floor 15' of heel recess 15. During the course of the subsequent swing or float phase of the gait, where the foot is free of weight bearing, the bladder 31 deflates under the influence of the thrust plate 25 and which plate 25 is itself biased to the closed condition by the action of the tensioned collar 33. Thus, bladder 30 is reinflated through passageway 32, thereby biasing the pressure plate 18 upwardly to its original resting state spacing from the floor 15'. Upon achievement of this spacing, the valve 50 is closed by the actuator arm 51, thus restoring the sole construction to the condition depicted in FIG. 1 and preparing it for the next heel strike event.

Figure 6:
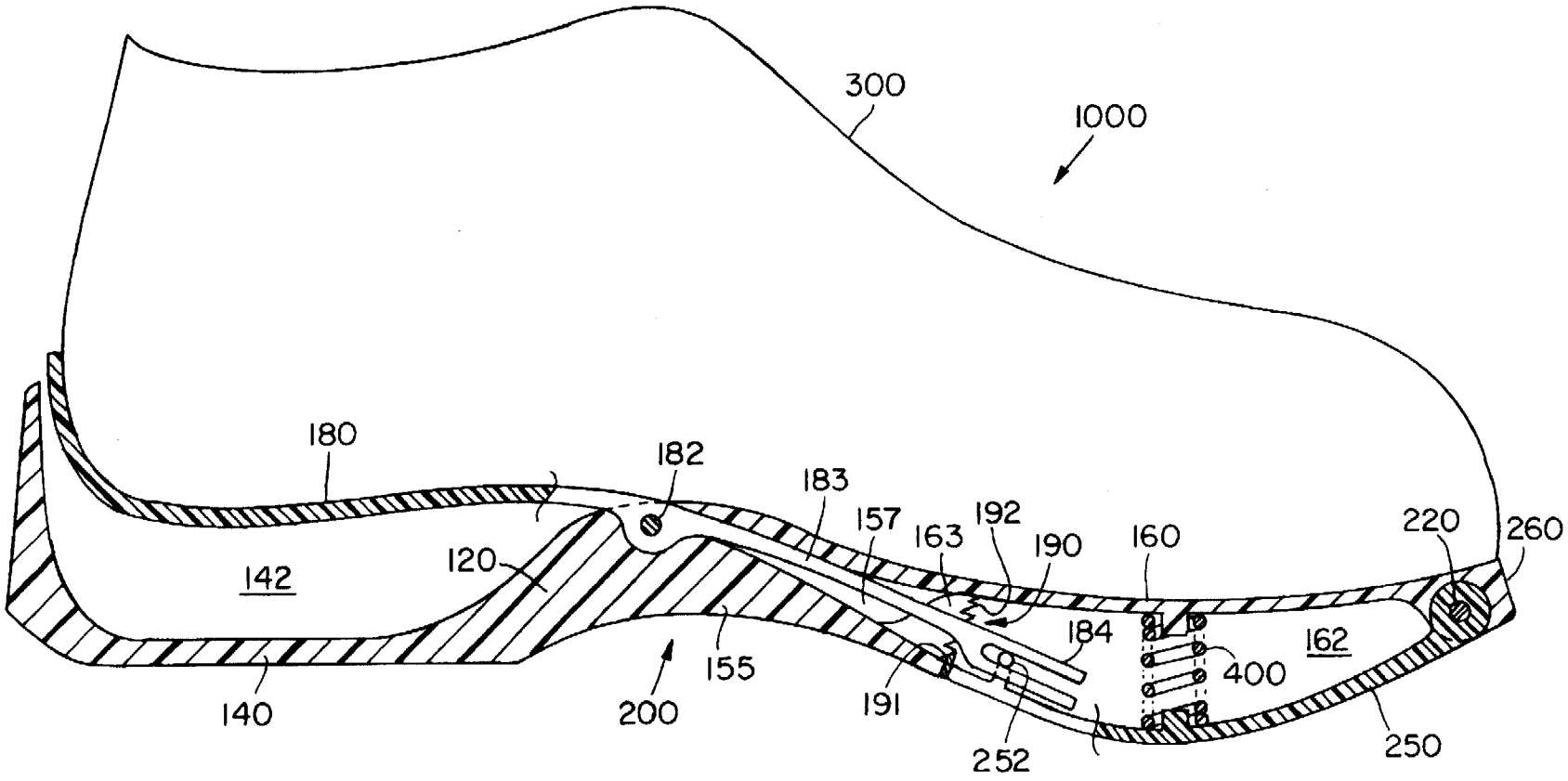
FIG. 6 herein is a schematic, diagrammatic and sectional side view of an athletic shoe in accordance with another embodiment of the invention, shown in the swing or float phase of the gait, and wherein the energy absorption, storage, control and propulsive elements thereof are in the nature of a number of intercommunicating mechanical elements suitably stored within the sole of the shoe.

A non-pneumatic embodiment of the invention is illustrated in FIG. 6 hereof. Here, a mechanical system employing a compression spring mounted in the forefoot area of the sole is utilized to absorb, store and return at least a portion of the heel strike impact energy to the propulsive phase of the gait. Referring now to said FIG. 6, there is shown a shoe 1000 generally comprising a shoe sole construction 200 and a shoe upper 300 suitably affixed thereto. The shoe sole construction 200 comprises a shoe sole element 120 running the entire length of the shoe sole and having heel, arch and forefoot portions 140, 155 and 160, respectively, which correspond to the anatomical heel, arch and forefoot portions of the wearer's foot. The arch portion 155 is relatively rigid in nature while the forefoot portion 160 is relatively flexible, such that, under the loads imposed by the wearer, the latter will flex relative to the arch portion 155. The heel portion 140 comprises a heel recess 142 defined in the upper surface thereof while forefoot portion 160 comprises a recess 162 defined in the underside thereof. As in the embodiment of the invention shown in FIGS. 1 through 5, the embodiment of the invention shown in FIG. 6 also includes a relatively rigid thrust plate element 250 running under the forefoot portion 160 of the shoe sole element 120 and which thrust plate element 250 is pivotally affixed to the forward end portion of toe 260 of said forefoot portion 160 such as by means of a hinge element 220 running transversely thereacross.

Disposed above the heel recess 142 is a rigid heel pressure plate 180, said plate 180 preferably being shaped to comfortably receive the heel of the foot of the wearer. The forward end of the heel pressure plate 180 is pivotally affixed to the arch portion 155, such as by means of transversely oriented hinge element 182, thereby to allow up and down motion of the plate within said heel recess 142. However, unlike the embodiment of the invention shown in FIGS. 1 through 5 wherein the heel strike energy absorption and storage elements of the construction are contained within the heel portion of the sole construction, the embodiment of the invention shown in FIG. 6 comprises a forwardly extending arm 183 integral with and extending forwardly of the heel pressure plate 180 and which forwardly extending arm 183 is mounted within a longitudinally oriented slot 157 in the arch portion 155. Said forwardly extending arm 183 terminates in the form of a horizontally disposed fork element 184 disposed within the forefoot recess 162 of the sole element 200. Said fork element 184 receives and engages a T-shaped trunnion 252 which is integral with and extends upwardly from the upper surface of the rearward end portion of said thrust plate 250. Thus, upward motion of the rearward end portion of said pivotally mounted thrust plate 250 is slaved to the motion of said fork 184. Located within the forefoot recess 162 of the sole element 200 is a compression spring 400 which serves as the principal energy storage means of the construction and whose respective ends are affixed to the lower surface of said forefoot recess 162 of the sole element 200 and the upper surface of said thrust plate 250. Unlike the embodiment of the invention shown in FIGS. 1 through 5 wherein anatomical control of the storage and recovery of the absorbed heel strike impact energy is, at least in part, achieved by latch means contained within the heel portion of the sole element, in the embodiment of FIG. 6, the control of said energy storage and recovery function is achieved by means of latch means 190 contained within the forefoot recess 162. The function of said latch means 190 is automatically controlled by the natural anatomical articulation between the forefoot and mid-foot of the wearer. Thus, in the embodiment of the invention depicted in said FIG. 6, control of the storage and recovery of the energy received and stored into the compression spring 300 is achieved by said latch means 190, comprising a latching barb 191 extending upwardly and oriented rearwardly from the the thrust plate 250 and which rearwardly oriented barb 191 temporarily engages one or the other of a vertically and forwardly oriented corresponding sawtooth array of plural forwardly extending sawtooth notches 192 tranversely formed in the depending back wall 163 of the forefoot recess 162. Said back wall 163 of the forefoot recess 162 is in correspondence with and depends below the anatomical juncture of the fore and mid-foot of the wearer, thereby to articulate about said juncture as the wearer's foot responds anatomically to the running gait.

As will be appreciated by reference to the construction depicted in FIG. 6 and from the foregoing description of the elements thereof, during the heel strike of the wearer upon the heel plate 180 and its resulting downward displacement into the heel recess 142 the forwardly extending arm 183 is stroked upwardly about the pivot 182, and by the mechanical association of the fork 184 thereof with the trunion 252 of the thrust plate 250, causes the rearward portion of said plate 250 to be forced upwardly into the recess 162 of the forefoot sole portion 160, thereby compressing the spring 300 contained therewithin and storing at least a portion of the heel strike energy in said apring. Of course, because the wearer's forefoot and mid-foot are in neutral relative positions at this stage of the gait, the vertical array of sawtooth notches 192 of the back wall 163 is positioned in the engagement mode. Thus, one or the other of the notches 192 captures the barb 191 of the thrust plate 250, thereby maintaining the spring 300 in the compressed condition. As the runner's foot rolls forwardly into the propusive phase of the gait, however, the forefoot portion 160 flexes relative to the arch portion 155, thereby bringing the sawtooth notches 192 out of engagement with the barb 191 and permitting the spring 300 to release its stored energy into the thrust plate 250. Concomitantly, arm 183 is driven downwardly, thereby to raise the heel pressure plate 180 within the heel recess 142 in preparation for the next heel strike thereupon.

While the foregoing description demonstrates certain embodiments of the invention and techniques for implementation and use thereof, it should be recognized and understood that said description is not to be construed as limiting of the invention because many obvious changes, modifications, variations and substitutions of equivalents may be made therein without departing from the essential scope, spirit or intention of the invention. For example, where the arm 183 of the mechnical embodiment shown in FIG. 6 is not rigid but, instead, is in the nature of an appropriately constructed leaf spring, it is obvious that said arm can itself serve as the energy storage component of the construction and can thus be substituted for the compression spring 300. Accordingly, it is intended that the invention is to be limited only by the scope of the appended claims.

What is claimed is:

1. A shoe sole construction adapted to absorb and store at least a portion of the impact energy received from the heel strike of a wearer's gait and to deliver at least a portion of said stored energy into the propulsive phase of the gait, said shoe sole construction comprising:

(A) a shoe sole element of resilient rubber construction and having heel and forefoot portions, said forefoot portion including the toe of the sole;

(B) impact energy absorption means acting to receive the heel strike energy of the wearer and to deliver at least a portion thereof to the energy storage means of (C);

(C) energy storage means to receive and store impact energy delivered thereto by (B) and to deliver said stored energy to the propulsion means of (E);

(D) thrust plate means disposed under said forefoot portion and being pivotally affixed to the toe thereof;

(E) propulsion means disposed in said forefoot portion, said propulsion means communicated with said energy storage means of (C) and acting to receive the stored energy of said energy storage means and to propel said pivotally affixed thrust plate means downwardly in response thereto; and (F) control means responsive to the changing forefoot anatomy of the wearer's foot during the act of running, said control means acting to release the stored energy of said energy storage means of (C) to said propulsion means of (E) during the propulsive phase of the wearer's gait and to restore said energy absorption means of (B) to its pre-impact condition prior to the next heel strike event thereupon.

2. The shoe sole construction of claim 1 wherein said heel portion comprises an upper surface having a recess therein and wherein said impact energy absorption means comprises a rigid heel pressure plate disposed over said recess and affixed to the shoe sole in a manner which permits said pressure plate to move downwardly into said recess under the influence of the wearer's heel strike thereupon.

3. The shoe sole construction of claim 1 wherein said energy storage means comprises a pneumatic bladder.

4. The shoe sole construction of claim 1 wherein said energy storage means comprises a spring.

5. The shoe sole construction of claim 2 wherein said control means includes latch means to temporarily maintain said heel pressure plate in a downward condition between the end of the heel strike event and the onset of the propulsive phase of the wearer's gait.

6. The shoe sole construction of claim 1 wherein said propulsion means comprises a pneumatic bladder.

7. The shoe sole construction of claim 1 wherein said energy storage means and said propulsion means comprises a spring.

8. A shoe sole construction adapted to absorb and store at least a portion of the impact energy received from the heel strike of a wearer's gait and to deliver at least a portion of said stored energy into the propulsive phase of the gait, said shoe sole construction comprising:

(A) a shoe sole element of resilient rubbery construction and having heel and forefoot portions, said forefoot portion including the toe of the sole;

(B) said heel portion of said shoe sole element comprising a first inflated pneumatic bladder positioned to be compressed under the impact energy of a heel strike thereupon and to maintain said compressed state until initiation of the propulsive phase of the gait, thereby to absorb and store at least a portion of the impact energy of said heel strike;

(C) said forefoot portion of said shoe sole comprising a thrust plate disposed under said forefoot portion and being pivotally affixed to the toe thereof and a second pneumatic bladder in controlled fluid communication with said first bladder, said second pneumatic bladder being disposed between said shoe sole and said thrust plate;

(D) means to control said fluid communication between said first and second bladder, said means including a valve responsive to the anatomical condition of the forefoot during the running gait and acting (i) to open said fluid communication between said first and second bladders during the propulsive phase of the gait, thereby to inflate said second bladder and deflate said first bladder during said propulsive phase and to reinflate said first bladder and deflate said second bladder upon completion thereof, and (ii) to close said fluid communication upon said reinflation of said first bladder.

* * * * *